United States Patent [19]

Grilliot et al.

[11] Patent Number: 4,768,233

[45] Date of Patent: Sep. 6, 1988

[54] FIREFIGHTER'S GARMENTS HAVING REMOVABLE BUT DETECTABLE LINER

[76] Inventors: William L. Grilliot; Mary I. Grilliot, both of 1986 Home Ave., Dayton, Ohio 45417

[21] Appl. No.: 118,276

[22] Filed: Nov. 6, 1987

[51] Int. Cl.[4] ..... A41D 1/02; A41D 13/00

[52] U.S. Cl. ..... 2/81; 2/93; 2/96; 2/97; 2/DIG. 6

[58] Field of Search ..... 2/81, 97, 85, 272, 93, 2/96, DIG. 6, 82

[56] References Cited

U.S. PATENT DOCUMENTS

| | | | |
|---|---|---|---|
| 762,772 | 6/1904 | Terramorse | 2/85 |
| 3,805,296 | 4/1974 | Frick | 2/93 |
| 4,103,361 | 8/1978 | Carmen | 2/97 |
| 4,507,806 | 4/1985 | Coombs . | |
| 4,709,421 | 12/1987 | Grilliot et al. | 2/81 |

*Primary Examiner*—H. Hampton Hunter
*Attorney, Agent, or Firm*—Jacox & Meckstroth

[57] ABSTRACT

A firefighter's garments include a coat and trousers. Each of these garments has an outer shell and an inner liner. The inner liner has a section secured thereto which is attached to the outer shell and which serves as an important part of the outer shell. Therefore, when the inner liner is removed from the garment, the garment is not readily usable by a firefighter. In one embodiment of the invention the section which is secured to the inner liner serves as an element for attaching together two separable parts of the front portion of the coat or trousers. Therefore, when the inner liner is removed from the outer shell, the front parts of the garment cannot be attached together and the garment cannot be used by a firefighter. In another embodiment of the invention, the inner liner is attached to the cuff portions of the trousers and to the cuff portions of the coat. The cuff portions may be significant parts of the garment. Therefore, when the inner liner is removed, the garment does not have cuffs and is not readily usable.

17 Claims, 5 Drawing Sheets

FIREFIGHTER'S GARMENTS HAVING REMOVABLE BUT DETECTABLE LINER

BACKGROUND OF THE INVENTION

A firefighter's garments customarily have a plurality of layers. Customarily, each layer is of a material different from the materials of the other layers, and each layer serves a purpose different from the purpose of the other layers.

A firefighter's coat and a firefighter's trousers each have an inner liner or thermal barrier. Customarily, the inner liner and the other layers of the garment are attached together as a unit. This has become a custom because a firefighter has historically demonstrated the desire and tendency to remove a detachable inner liner from a firefighting garment. This is particularly true during hot weather. Removing the inner liner makes the garment cooler and more comfortable and reduces stress upon the firefighter, but also makes the garment unacceptable for firefighting protection.

This problem has become so significant that firefighting administrators now customarily request that an inner layer of a firefighter's garment be stitched to other layers of the garment to prevent disassembly of the garment. The permanent attachment of an inner liner to the other layers of a firefighter's garment has several disadvantages, as discussed below. However, stitching of an inner liner to the other layers of a firefighter's garment continues to be a custom, because with the use of conventional firefighter garments, a firefighting administrator cannot readily visually determine that a firefighter is wearing a garment which has no inner liner.

As stated above, problems exist with regard to a firefighter's garment in which all layers are stitched together. During the fighting of a fire, the inner liner usually becomes saturated with perspiration. It is, of course, desirable to clean the inner liner. When the inner liner is attached to the other layers of the garment, the entire garment must be cleaned as a unit. Of course, it is desirable to clean the entire garment. However, the outer layer is covered with smoke and ashes and the like, and it is desirable to clean the inner liner in a different manner and/or in different solution from that in which the inner liner is cleaned. Also, an outer layer or an inner layer sometimes wears out or becomes damaged. It is desirable to be able to replace the damaged or worn layer without replacing the other layers.

This problem has been addressed in U.S. Pat. No. 4,507,806. This patent shows a firefighter's coat which has a collar which is attached to an inner liner. Therefore, the collar is removed when the inner liner is removed from the garment. Such a firefighter's garment is helpful toward solving the problem discussed above. However, when a firefighter is completely dressed for firefighting, with mask, helmet with ear flaps, etc., the absence of a collar from the coat may not be readily observable. However, the coat is usable even though the coat does not have a collar.

It is therefore an object of this invention to provide a firefighter's garment which has an inner liner or thermal barrier which is easily removable from the other layers of the garment.

It is another object of this invention to provide means and a method by which an inner liner or thermal barrier in a firefighter's coat is removably attached to an outer layer.

It is another object of this invention to provide a means and a method by which an inner liner or thermal barrier in a firefighter's trousers is removably attached to an outer layer.

Another object of this invention is to provide such a garment for a firefighter in which the garment is not readily usable as a firefighting garment when the inner liner is removed.

It is another object of this invention to provide such a garment in which the outer appearance of the firefighter's garment is significantly changed when the inner liner is not present in the garment.

Other objects and advantages of this invention reside in the construction of parts, the combination thereof, the method of production and the mode of use as will become more apparent from the following description.

SUMMARY OF THE INVENTION

This invention comprises a means and a method by which an inner liner in a firefighter's coat and an inner liner in a firefighter's trousers are attached to an outer layer and are readily removable and replaceable. The inner liner is attached to the other layers by a section which is secured to the inner liner but which is readily detachable from the other layers.

For example, a section of the front portion of a firefighter's coat is secured to the inner liner of the coat but that section is readily removable from the other layers of the coat. A section of the front portion of the firefighter's trousers is secured to the inner liner but is readily removable from the other layers of the trousers. The front portion of each garment has two separable parts. The section which is attached to the inner layer also attaches together the two front parts of the garment. Therefore, the garment is not readily usable as a firefighter's garment when the inner layer is removed therefrom.

Also, in accordance with this invention, a cuff section of a firefighter's coat and a cuff section of a firefighter's trousers are secured to the inner liner thereof, but is readily removable from the other layers of the garment. The section of the garment which is secured to the inner liner is readily attachable and detachable with respect to the other layers by quick release means. The cuff portions are important portions of the garment and may form a significant part of a sleeve of a firefighter's coat or a significant part of a leg portion of a firefighter's trousers. Therefore, the garment is not readily usable when the inner layer is removed therefrom.

DETAILED DESCRIPTION OF THE PREFERRED EMBODIMENT

Figure 1:
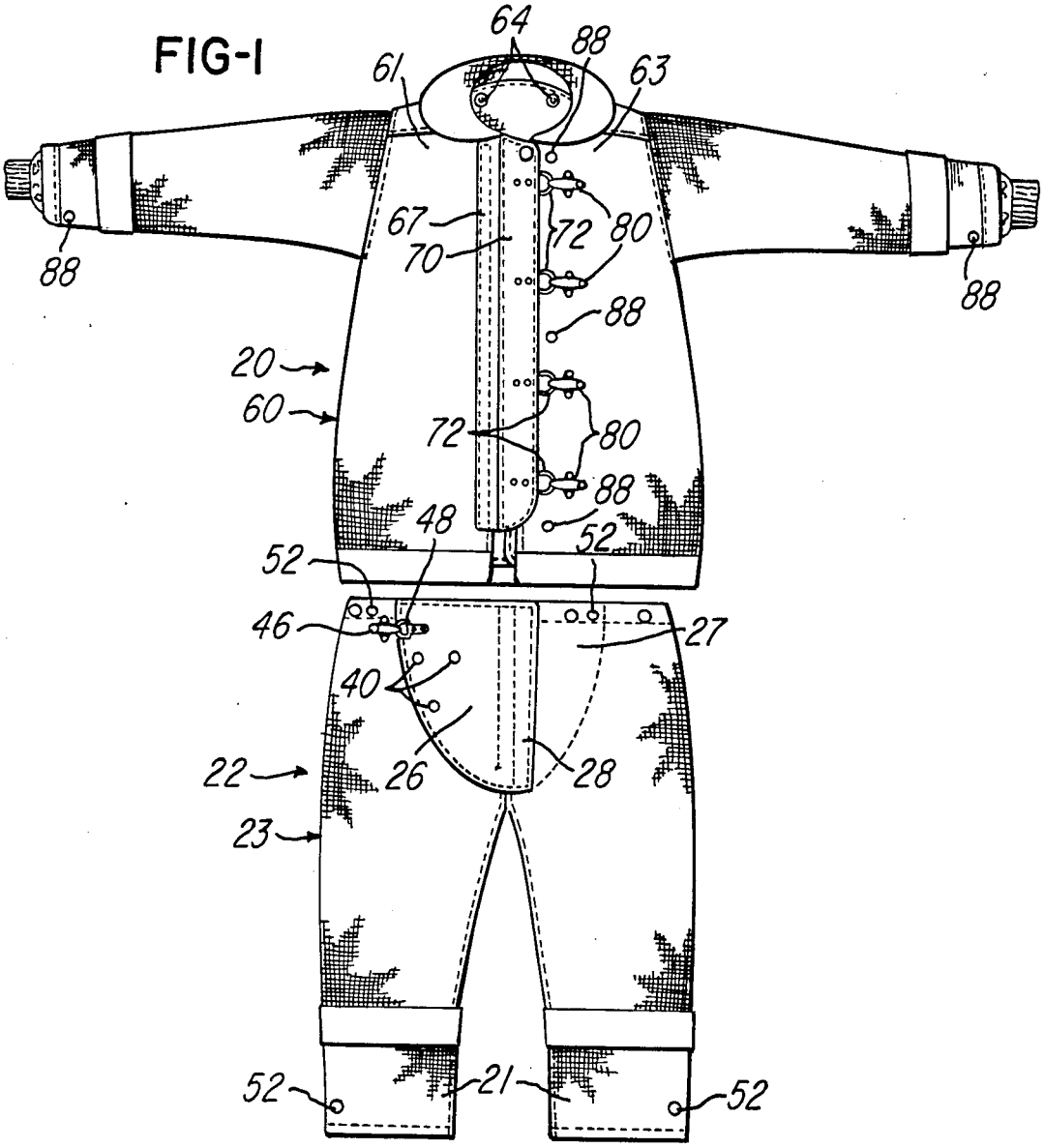
FIG. 1 is a front view of a firefighter's coat and a firefighter's trousers which are constructed in accordance with this invention.

FIG. 1 shows a coat or jacket 20 and a trousers 22, both of which are constructed in accordance with this invention.

Figure 2:
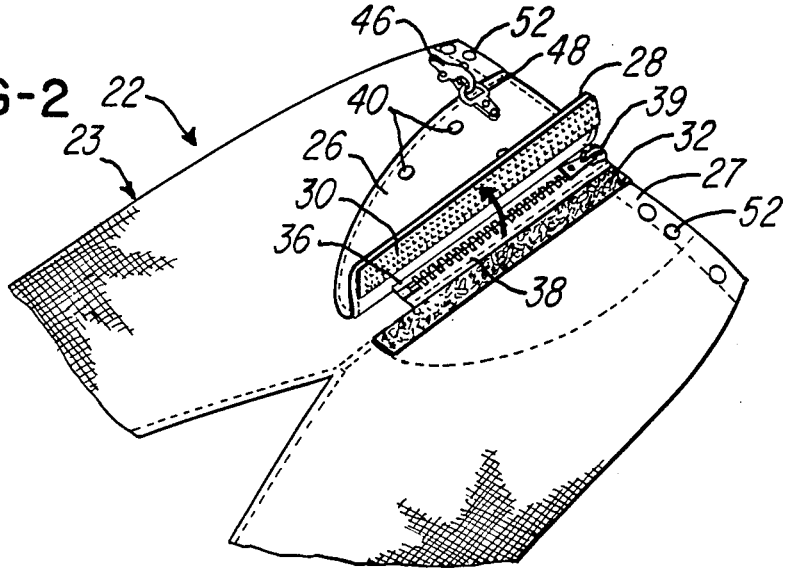
FIG. 2 is a fragmentary perspective view showing a portion of the firefighter's trousers and illustrating the manner in which a section which is secured to the inner liner is also releasably attached to the outer layer of the trousers.
Figure 4:
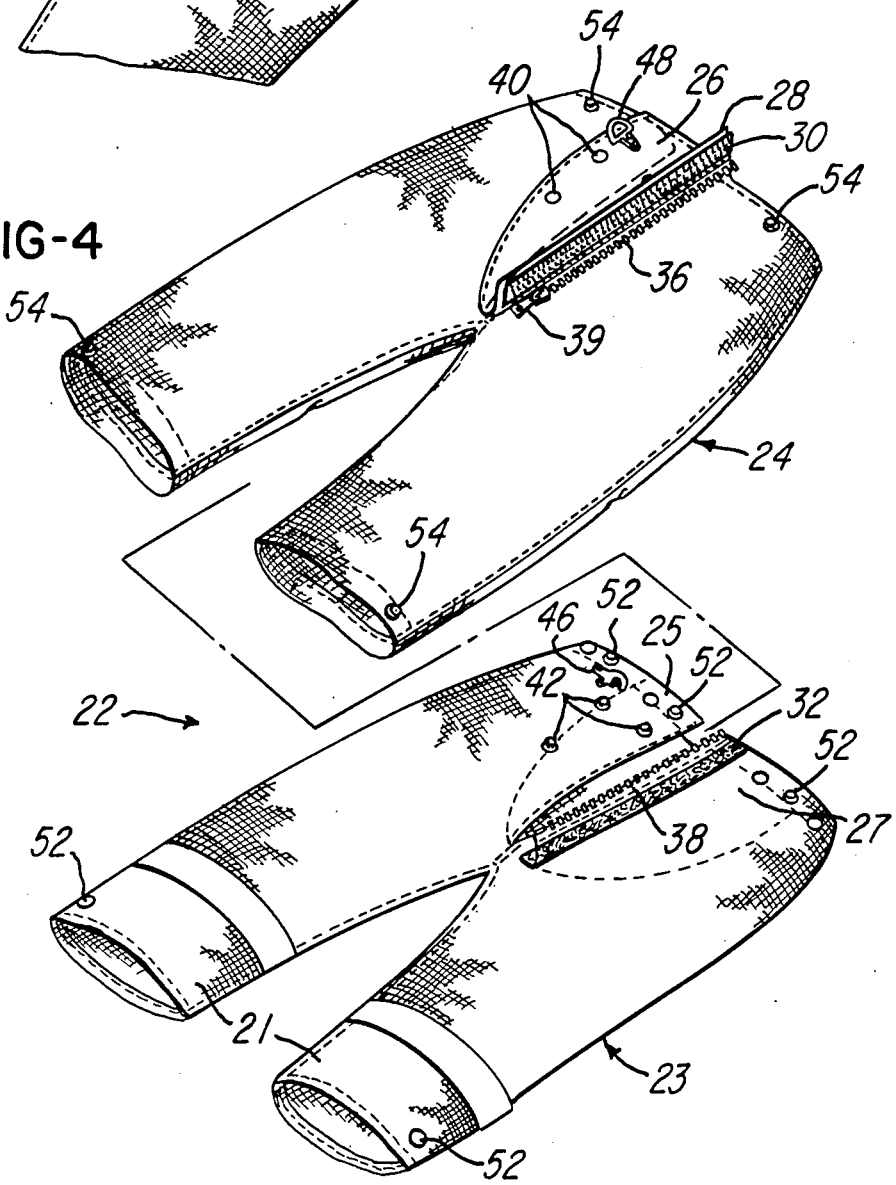
FIG. 4 is a perspective exploded view showing the inner liner of the trousers removed from the outer layer of the trousers.

The trousers 22 are shown as having cuffs 21. The trousers 22 include an outer layer 23 and an inner liner or inner layer or thermal barrier 24. The outer layer 23 has a front part 25 and a front part 27, as best shown in FIG. 4. The inner liner 24 is best shown in FIG. 4. Secured to the inner liner 24 is a flexible connection section 26. Foldably attached to the flexible section 26 is a flap 28 which has secured thereto a strip 30 of hook and pile material. The strip 30 of hook and pile material is adapted to be attached to a complementary strip 32 of hook and pile material, which is secured to the part 27, as illustrated in FIG. 2. A slide fastener portion 36 is secured to the flap 28, and a slide fastener portion 38 is secured to the part 27 of the outer shell 23. A slide fastener tab 39 is attached to the slide fastener portions 36 and 38.

Figure 3:
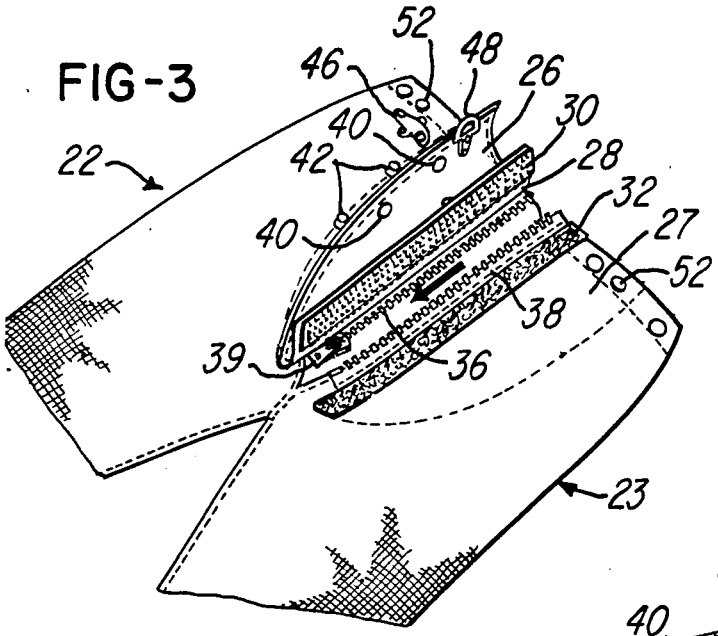
FIG. 3 is a fragmentary perspective view, similar to FIG. 2, and illustrating the manner by which a section which is secured to the inner layer is detachable from the outer layer of the trousers.

Secured to the flexible connection section 26 is a plurality of pressure snap elements 40 which are releasably attached to complementary pressure snap elements 42, which are secured to the part 25 of the front portion of the outer shell 23. The snap elements 42 are normally covered by the section 26. A snap hook 46 is shown attached to the outer shell 23. A ring 48 is attached to the flexible connection section 26. The snap hook 46 is normally attached to the ring 48, as shown in FIGS. 2 and 3.

The upper portion of the outer line 23 and one each of the cuffs 21 is shown as having a pressure snap 52 which is releasably attached to the inner liner 24 by means of complementary pressure snaps 54 which are secured to the inner liner 24.

When the firefighter desires to remove the trousers 22, the snap hook 46 is removed from the ring 48 which is secured to the flexible connection section 26, and the pressure snaps 40 which are secured to the inner liner 24 are released from the pressure snaps 42 which are secured to the part 25 of the outer shell 23. Thus, the flexible connection section 26 is released from the part 25 of the front portion of the outer shell 23 and the trousers 22 can be removed from the firefighter.

When the trousers 22 are removed from the firefighter and when it is desired to remove the inner liner 24 from the outer shell 23, the strip 30 of hook and pile material which is attached to the flap 28 is detached from the strip 32 of hook and pile material which is secured to the part 27 of the outer shell 23. Then, as shown in FIG. 3, the slide fastener tab 39 is moved downwardly, detaching the slide fastener portion 36 from the slide fastener portion 38. Then the pressure snaps 52 of the cuffs 21 and the upper portion of the liner 23 are detached from the pressure snaps 54 which are secured to the inner liner 24. Thus, the inner liner 24 is free from attachment to the part 27 of the front portion of the outer shell 23 and can be removed from the outer shell 23, as illustrated in FIG. 4. Thus, the inner liner or thermal barrier 24 can be cleaned in an operation and solution separate from that in which the outer shell 23 is cleaned. Furthermore, a new inner liner 24 can be inserted into the outer shell 23 if an inner liner is damaged or not reusable. Due to the fact that section 26 and the slide fastener portion 36 and the strip 30 of hook and pile material are removed from the part 27 of the outer shell 23 with the inner liner 24, the parts 25 and 27 of the front portion cannot be attached together. Thus, the trousers 22 cannot be worn when the inner liner 24 is removed from the trousers 22.

Figure 5:
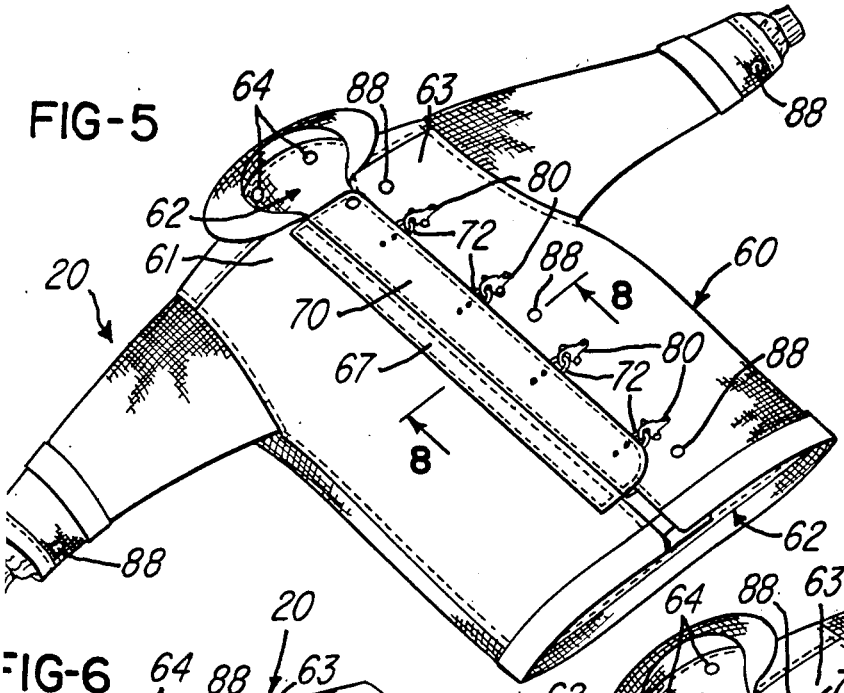
FIG. 5 is a perspective view of a firefighter's coat or jacket which is constructed in accordance with this invention.
Figure 6:
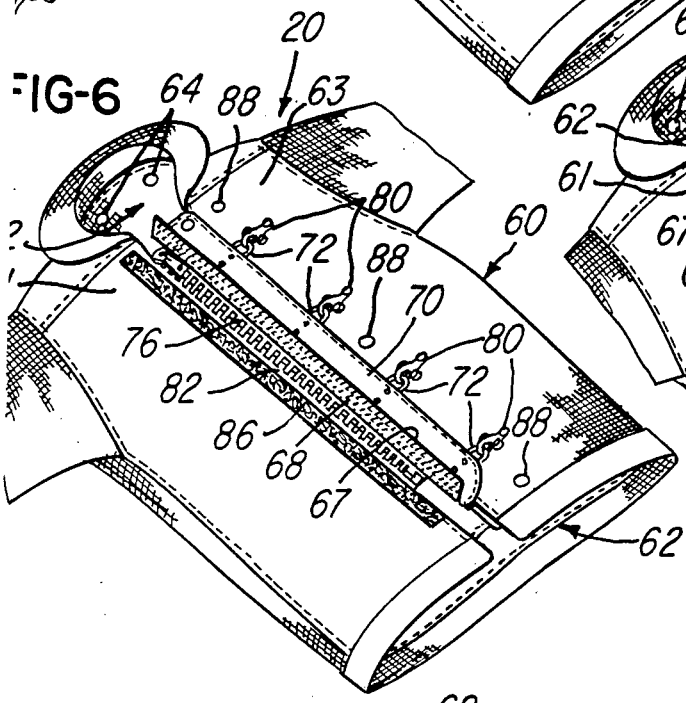
FIG. 6 is a fragmentary perspective view of the coat of FIG. 5 illustrating the manner by which a section which is secured to the inner liner is releasably attached to the outer layer.
Figure 7:
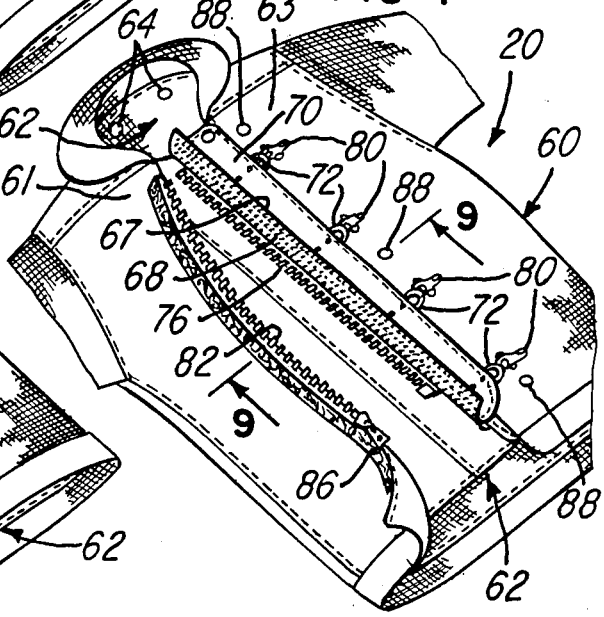
FIG. 7 is a fragmentary perspective view illustrating the manner by which the section is releasable from the other layers.
Figure 10:
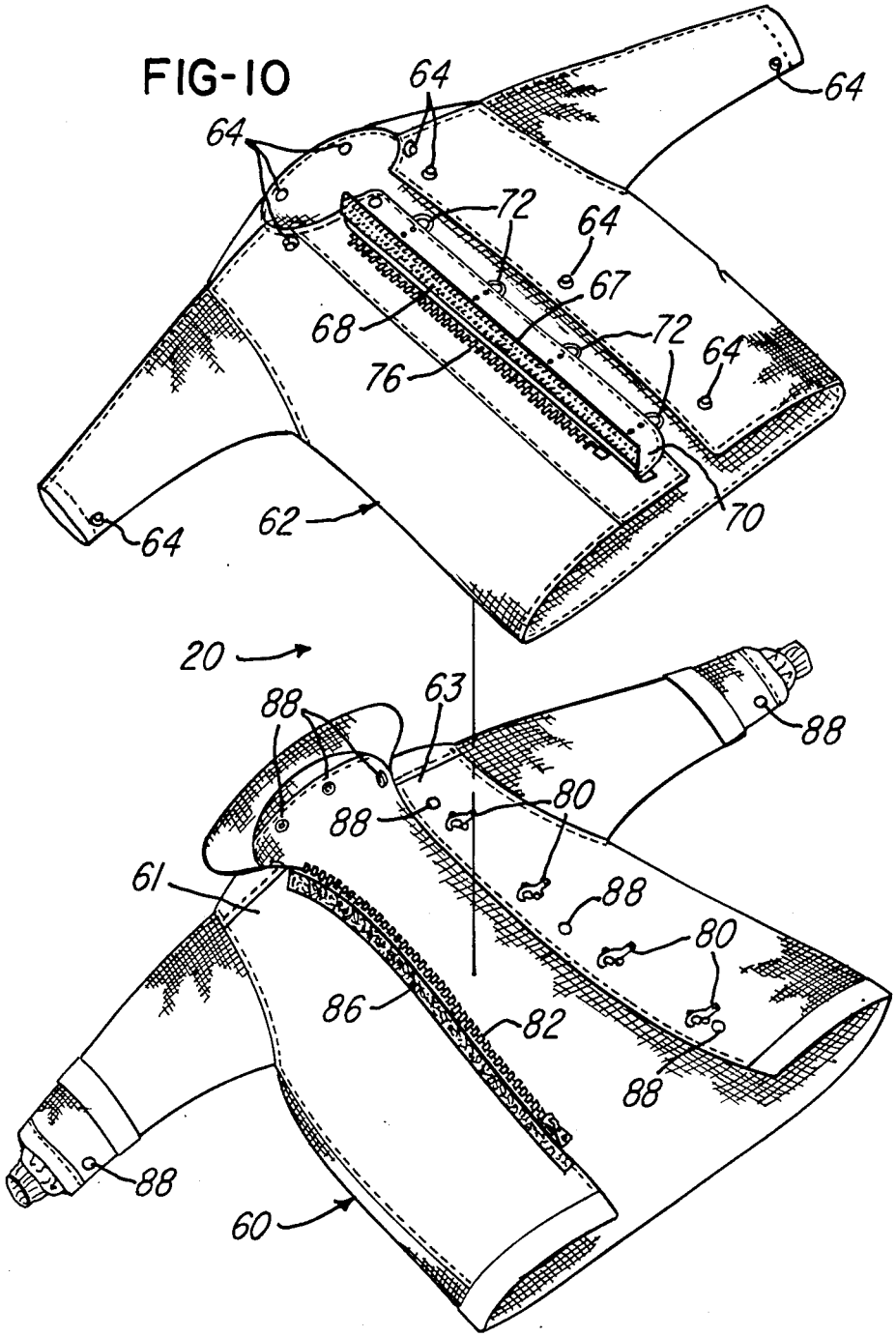
FIG. 10 is an exploded perspective view drawn on substantially the same scale as FIGS. 5, 6, and 7, and showing the inner liner removed from other layers of the coat.

FIG. 5 shows specifically the firefighter's coat or jacket 20 of FIG. 1 which is constructed in accordance with this invention. The coat or jacket 20 has an outer shell or outer layer 60, and an inner liner or inner layer or thermal barrier 62. The outer layer 60 has a front portion provided with a part 61 and a part 63. As shown in FIG. 10, the inner liner 62 is provided with pressure snaps 64 which are secured to the inner liner 62 at various spaced-apart portions thereof. The inner liner 62 also has a flap 67 to which is secured an elongate strip 68 of hook and pile material. The flap 67 is secured to a section 70 of the inner liner 62. The section 70 has spaced-apart rings 72 attached thereto along the length thereof.

Adjacent the flap 67 on the section 70 is a slide fastener portion 76.

Figure 8:
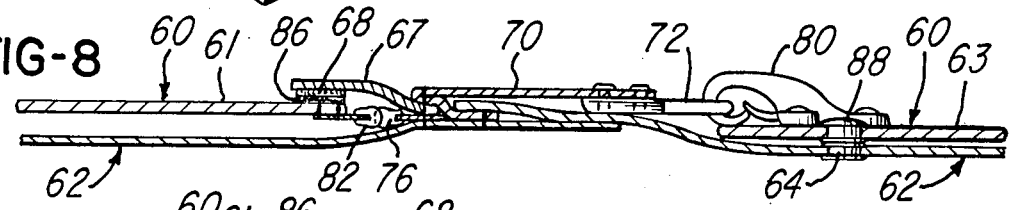
FIG. 8 is an enlarged fragmentary sectional view taken substantially on line 8—8 of FIG. 5.

The part 63 of the outer layer or shell 60 has a plurality of snap hooks 80 which are adapted to be attached to the rings 72 which are attached to the section 70. The part 61 of the outer layer 60 also has a slide fastener portion 82 which is normally attached to the slide fastener portion 76 of the inner liner 62. The part 61 of the outer shell 60 also has a strip 86 of hook and pile material which is complementary to the strip 68 which is secured to the flap 67. The strip 86 is normally attached to the strip 68, as shown in FIG. 8.

The part 63 of the outer liner 60 also has pressure snaps 88 which are adapted to be attached to the pressure snaps 64 which are carried by the inner liner 62. When the firefighter desires to remove the coat 20 the snap hooks 80 are removed from the rings 72, and the pressure snaps 88 which are adjacent the snap hooks 80 are removed from the pressure snaps 64. Thus, the section 70 is released from the front portion 63 of the outer shell 60, and the front parts 61 and 63 of the outer shell 60 are movable one from the other. In this condition, the coat 20 is removable from the firefighter.

Figure 9:
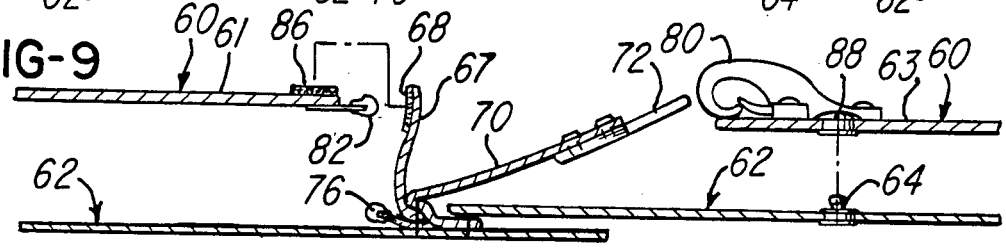
FIG. 9 is an enlarged fragmentary sectional view taken substantially on line 9—9 of FIG. 7.

After the coat 20 is removed from the firefighter and when it is desired to remove the inner liner 62 from the outer liner 60, the strip 68 of hook and pile material is removed from the complementary strip 86 of hook and pile material. Then the slide fastener portions 82 and 76 are separated, as illustrated in FIG. 9. Thus, the section 70 is released from the part 61 of the front portion of the outer shell 60. Thus, the inner liner 62 is removed from the outer liner 61, as illustrated in FIGS. 9 and 10.

Due to the fact that the section 70 is removed from the outer liner 60 with the inner liner 62, the parts 61 and 63 of the front part of the outer shell 60 cannot be attached together, and the coat 20 cannot be worn by a firefighter.

Figure 11:
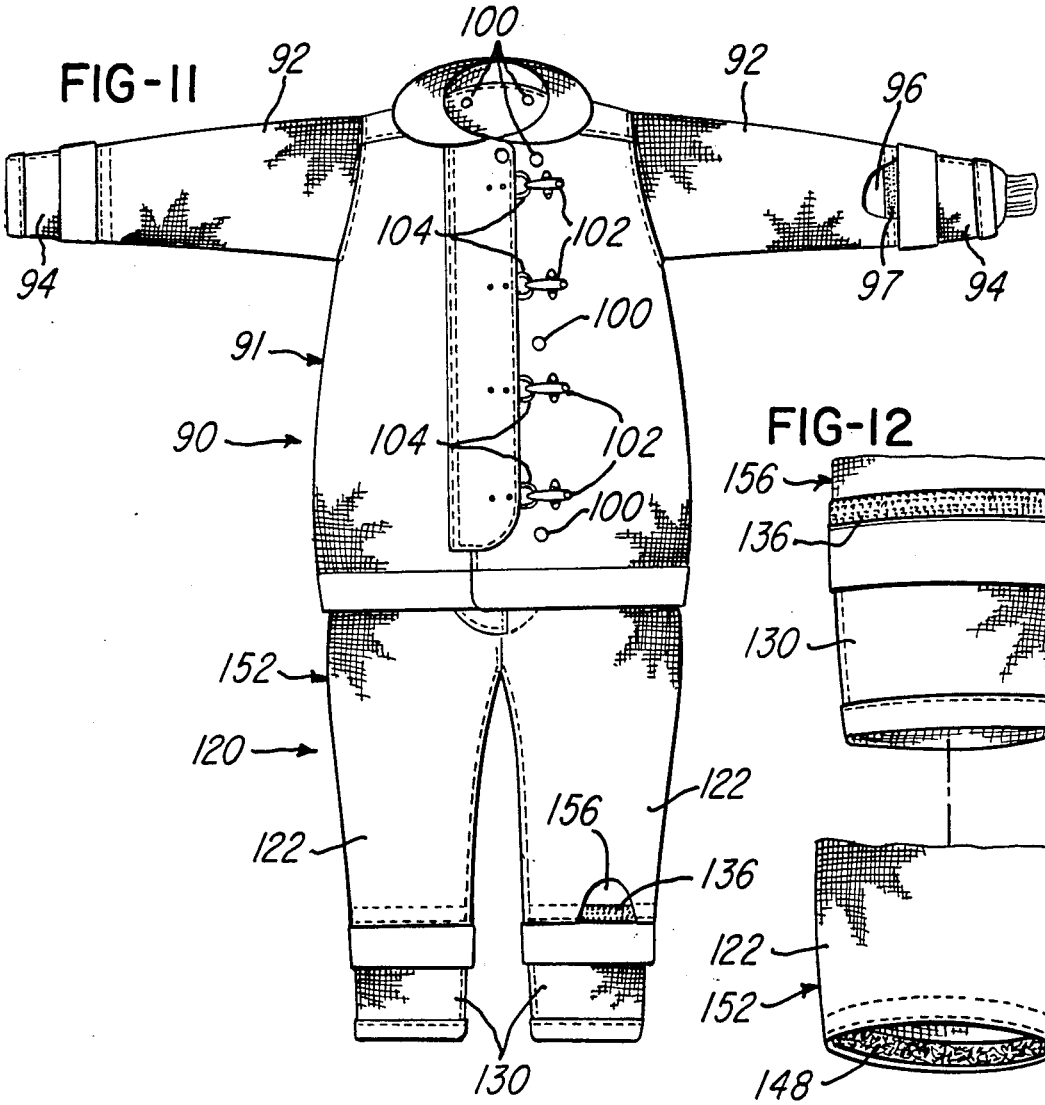
FIG. 11 is a front view of a firefighter's coat and trousers, with parts broken away, showing another embodiment of the invention of this application.
Figure 12:
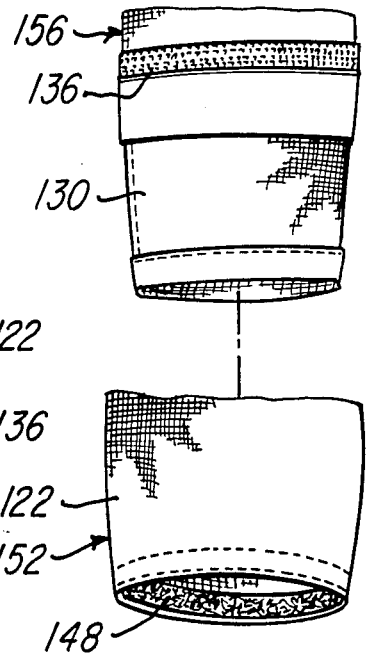
FIG. 12 is an enlarged fragmentary exploded view illustrating removal of the inner liner from the trousers.
Figure 13:
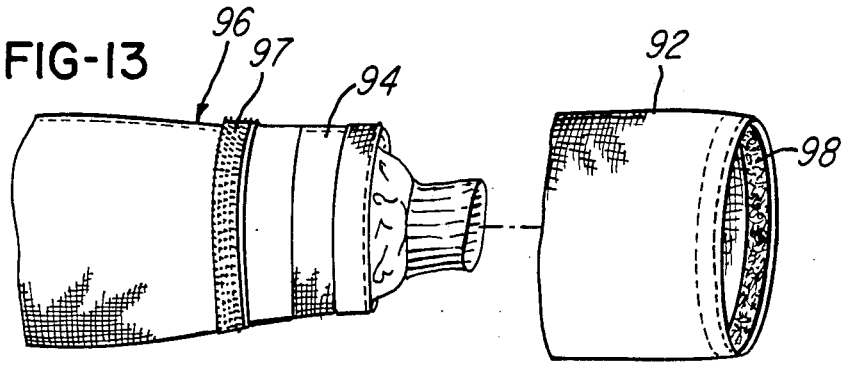
FIG. 13 is an enlarged fragmentary exploded view illustrating removal of the inner liner from the coat.

FIGS. 11, 12, and 13 illustrate another embodiment of this invention.

A coat or jacket 90 has an outer shell 91 which is provided with sleeves 92 which have cuff portions 94. The cuff portions 94 are part of an inner liner 96. The cuff portions 94 may be significant in lenght so that the cuff portions 94 form a substantial part of the arm protection of a firefighter. Each of the cuff portions 94 has a hook and pile element 97 secured thereto and encircling the cuff portion 94. Each of the sleeves 92 has a complementary hook and pile element 98 secured thereto and within the sleeve 92. The hook and pile elements 98 and 97 are attached together, to attach the inner liner 96 to the outer shell 91 at the sleeves 92. Also, the inner liner 96 is attached to the outer shell 91 by means of pressure snaps 100.

The outer shell 91 has snap hooks 102 and rings 104 which are attached together when the coat 90 is worn by a firefighter. When the firefighter desires to remove the coat 90 the snap hooks 102 are removed from the rings 104.

When the coat 90 is removed from the firefighter and when it is desired to remove the inner liner 96 from the outer shell 91, the hook and pile elements 97 and 98 are separated, and the pressure snaps 100 are separated. Thus, the inner liner 96 is removable from the outer shell 91. When this occurs the outer shell 91 does not have cuff portions and the coat 90 cannot be effectively worn by a firefighter.

FIG. 11 also shows trousers 120 having leg portions 122. Extending downwardly from each of the leg portions 122 is a cuff portion 130. Each of the cuff portions 130 may be significant in length and may form a substantial part of the leg protection of a firefighter. Each of the cuff portions 130 is encompassed by a hook and pile element 136. Each hook and pile element 136 is attached to a complementary hook and pile element 148 which is within each of respective leg portions 122. The trousers 120 comprise an outer shell 152 and an inner layer 156. Pressure snaps (not shown) also attach the inner liner 156 to the outer shell 152.

When the firefighter desires to remove the trousers 120, they are removed in a conventional manner. When it is desired to remove the inner liner 156 from the outer shell 152 the hook and pile elements 136 and 148 are separated and the pressure snaps, not shown, are separated. Thus, the inner liner 156 is removed from the outer shell 152. When this occurs, the trousers 120 do not have cuff portions 130 and cannot be effectively worn by a firefighter.

Thus, in summary, it is understood that in accordance with this invention an inner liner is removably attached to an outer shell of a firefighter's garment. The inner liner has a portion which is attached to the outer shell, and the garment cannot be effectively worn by a firefighter when the inner liner is removed.

Although the preferred embodiment of the firefighter's garments of this invention has been described, it will be understood that within the purview of this invention various changes may be made in the form, details, proportion and arrangement of parts, the combination thereof, the method of construction and the mode of use, which generally stated consist in a structure and method within the scope of the appended claims.

The invention having thus been described, the following is claimed:

1. A firefighter's garment comprising: an outer layer and a separable inner layer, the outer layer having a front portion provided with two separable parts, the inner layer being positioned within the outer layer and having a front portion, and connection means secured to the inner layer and releasably attaching together the two parts of the front portion of the outer layer, whereby said garment is incomplete and not usable without the inner layer and connection means thereon.

2. The firefighter's garment of claim 1 in which the front portion of the outer layer has a first part and a second part, and in which the connection means includes a flexible connection section, a first hook and pile element, the first hook and pile element being secured to first part of the outer layer and a complementary hook and pile element attached to the connection section, the first hook and pile element being attachable to the complementary hook and pile element, and means releasably attaching the connection section to the second part of the front portion of the outer layer.

3. The firefighter's garment of claim 1 in which the front portion of the outer layer has a first part and a second part, the parts being relatively movable, and in which the connection means includes a flexible connection section which is secured to the inner layer, operable means releasably attaching the connection section to first part of the outer layer, a first hook and pile element, the first hook and pile element being secured to second part of the outer layer, a complementary hook and pile element attached to the connection section, the first hook and pile element being attachable and detachable with respect to the complementary hook and pile element, a first slide fastener element, the first slide fastener element being secured to the connection section, and a second slide fastener element, the second slide fastener element being secured to the outer layer, the first slide fastener element being attachable and detachable with respect to the second slide fastener element, the garment being removable from a firefighter by operating the operable means to release the connection section from the outer layer, the inner layer being removable from the outer layer by detaching the first hook and pile element from the complementary hook and pile element and by detaching the first slide fastener element from the second slide fastener element.

4. The firefighter's garment of claim 1 in which the garment comprises a coat.

5. The firefighter's garment of claim 1 in which the garment comprises trousers.

6. The firefighter's garment of claim 1 in which the front portion of the outer layer has a first part and a second part, and which includes a snap hook element releasably attaching the connection means to the second part of the outer layer for donning the garment and for removal of the garment from the firefighter, and which includes releasable means attaching the connection means to the first part of the front portion of the outer layer for attachment of the inner layer to the outer layer and for removal of the inner layer from the outer layer.

7. A firefighter's garment of the type comprising a first outer layer and a second inner layer, the second inner layer including an extension portion extending beyond said/first outer layer without which extension portion the garment is incomplete and not usable, and releasable attachment means secured to the extension portion of the second inner layer and cooperable releasable attachment means secured to said first outer layer, said releasable attachment means releasably attaching the layers together.

8. The firefighter's garment of claim 7 in which the extension portion includes a cuff element and the attachment means includes a hook and pile element.

9. The firefighter's garment of claim 7 in which the first layer has a front portion provided with two separable parts, there being a first part and a second part, and in which the extension portion comprises a flexible section secured to the second layer, the attachment means including a first slide fastener element, the first slide fastener element being secured to the flexible section, a second slide fastener element, the second slide fastener element being secured to the first part of the front portion of the first layer, the slide fastener elements being attachable one to the other and means for releasably attaching the flexible section to the second part of the front portion of the first layer for attaching together the two parts of the front portion of the first layer, whereby release of the flexible section from the second part of the front portion permits the garment to be removed from the firefighter and whereby separation of the first slide fastener from the second slide fastener permits removal of the second layer from the first layer.

10. The firefighter's garment of claim 7 in which the garment comprises a coat provided with sleeves and in which the extension portion includes a section which extends from a sleeve of the coat.

11. The firefighter's garment of claim 7 in which the garment comprises trousers provided with leg parts, and in which the extension portion includes a section which extends from a leg part of the trousers.

12. The firefighter's garment of claim 7 in which the garment comprises a coat in which the first layer has a front portion provided with a first part and a second part, the extension portion being positioned between the first part of the front portion of the first layer and the second part of the front portion of the first layer, and the attachment means includes means releasably joining the extension portion to the first part of the front portion to the second part of the front portion of the first layer of the coat.

13. A firefighter's garment, which includes a first outer layer and a second inner layer, the first layer being provided with a front portion having two separable parts, there being a first part and a second part, comprising:

connection means secured to the second inner layer, first release means, the first release means releasably attaching the connection means to the first part of the front portion of the first outer layer for attaching the second inner layer to the first outer layer and for removal of the second layer from the first layer, and second release means, the second release means releasably connecting the connection means to the second part of the front portion of the first layer for attaching together the two parts of the front portion of the first layer for donning and for removal of the garment with respect to the firefighter, whereby said garment is incomplete and not usable without the second inner layer and the connection means thereon.

14. The method of producing a firefighter's garment comprising providing an outer layer, providing an inner layer, providing extension means, securing the extension means to the inner layer, providing cooperating attachment means, the attachment means including releasable attachment means, positioning the inner layer within the outer layer, and attaching one part of the cooperating attachment means to the outer layer and the other part of the cooperating attachment means to the extension means for releasably attaching the extension means and the inner layer to the outer layer whereby provision of said inner layer and the cooperating attachment means thereon complete the garment for use by a firefighter.

15. The method of claim 14 in which the outer layer has a first part and a second part, the method including releasably connecting the extension means to the first part of the outer layer for connecting the inner layer to the outer layer, and releasably attaching the attachment means to the extension means and to the second part of the outer layer for connecting the first part of the outer layer to the second part of the outer layer.

16. The method of claim 14 in which the firefighter's garment includes a coat provided with sleeve members, and in which the extension means includes a section extending from a sleeve member.

17. The method of claim 14 in which the firefighter's garment includes trousers provided with leg members, and in which the extension means includes a section extending from a leg member.

* * * * *